US007137635B2

(12) United States Patent
Haugen et al.

(10) Patent No.: US 7,137,635 B2
(45) Date of Patent: Nov. 21, 2006

(54) EXPANDABLE IN-LINE SKATE

(75) Inventors: Darrin John Haugen, Seattle, WA (US); John E. Svensson, Vashon, WA (US)

(73) Assignee: K-2 Corporation, Seattle, WA (US)

( * ) Notice: Subject to any disclaimer, the term of this patent is extended or adjusted under 35 U.S.C. 154(b) by 226 days.

(21) Appl. No.: 10/768,983

(22) Filed: Jan. 30, 2004

(65) Prior Publication Data

US 2004/0217562 A1 Nov. 4, 2004

Related U.S. Application Data

(63) Continuation-in-part of application No. 09/861,189, filed on May 18, 2001, now Pat. No. 6,918,601.

(51) Int. Cl.
*A63C 1/26* (2006.01)

(52) U.S. Cl. ..... 280/11.26; 280/11.27; 36/97

(58) Field of Classification Search ..... 280/11.26, 280/11.16, 11.221, 11.231, 11.27; 36/97
See application file for complete search history.

(56) References Cited

U.S. PATENT DOCUMENTS

| | | | |
|---|---|---|---|
| 311,077 | A | 1/1885 | Kitselman |
| 916,289 | A | 3/1909 | Fitzgerald |
| 2,572,050 | A | 10/1951 | Ornstein |
| 2,734,284 | A | 2/1956 | Seurbom |
| 3,086,787 | A | 4/1963 | Wyche |
| 3,997,985 | A | 12/1976 | Shiina |
| 4,083,128 | A | 4/1978 | Rossman |
| 5,184,834 | A | 2/1993 | Yu |
| 5,314,199 | A | 5/1994 | Olson et al. |
| 5,484,149 | A | 1/1996 | Lee |
| 5,513,861 | A | 5/1996 | Monroy et al. |
| 5,513,863 | A | 5/1996 | Klamer et al. |
| 5,645,288 | A | 7/1997 | Lu |
| 6,045,144 | A | 4/2000 | Wong |
| 6,217,039 | B1 | 4/2001 | Iverson et al. |
| 6,247,707 | B1 | 6/2001 | Conte |
| 6,276,697 | B1 | 8/2001 | Lin |
| 6,308,965 | B1 | 10/2001 | Yang |
| 6,450,510 | B1 | 9/2002 | Liu |
| 6,547,261 | B1 | 4/2003 | Gorza et al. |
| 6,612,592 | B1 | 9/2003 | Soo |
| 6,669,210 | B1 * | 12/2003 | Chen ..... 280/11.16 |

(Continued)

FOREIGN PATENT DOCUMENTS

| | | |
|---|---|---|
| DE | 174665 | 8/1905 |

(Continued)

*Primary Examiner*—Jeff Restifo
(74) *Attorney, Agent, or Firm*—Christensen O'Connor Johnson Kindness PLLC

(57) ABSTRACT

A skate (200) having a frame (226) adapted to support a plurality of wheels (228) and a base (214) disposed above the frame. The base includes a platform (280) having a longitudinal rail (282) with a plurality of locking detents (288), and an upwardly extending guide tab (284). A separable semirigid toe cup (216) includes an elongate slit (254) therethrough, and slidably engages the rail of the base, such that the toe cup can be adjusted longitudinally. An angled channel (264) in the toe cup engages the guide tab, such that the width of the slit, and therefore the width of the toe cup, increases as the toe cup is moved to lengthen the skate. In an alternative embodiment of the invention, a threaded post (302) extends transversely through the slit, permitting independent adjustment of the width of the toe cap.

21 Claims, 16 Drawing Sheets

U.S. PATENT DOCUMENTS 6,883,812 B1 * 4/2005 Hsieh ..... 280/11.231
6,916,027 B1 * 7/2005 Chen ..... 280/11.26
6,918,601 B1 * 7/2005 Sauter et al. ..... 280/11.26
6,918,602 B1 * 7/2005 Lu ..... 280/11.26
2003/0098554 A1 5/2003 Chen
2004/0094917 A1 * 5/2004 Frigo et al. ..... 280/11.31
2004/0107605 A1 * 6/2004 Caeran et al. ..... 36/117.1
2005/0179222 A1 * 8/2005 Eck ..... 280/11.15
2005/0257405 A1 * 11/2005 Kilgore ..... 36/97

FOREIGN PATENT DOCUMENTS

EP 1 258 268 A2 11/2002

* cited by examiner

EXPANDABLE IN-LINE SKATE

CROSS-REFERENCE TO RELATED APPLICATION

This application is a continuation-in-part of prior application Ser. No. 09/861,189, filed May 18, 2001, now U.S. Pat. No. 6,918,601, priority from the filing date of which is hereby claimed under 35 U.S.C. § 120.

FIELD OF THE INVENTION

The present invention relates to skates such as in-line skates and, in particular, to an in-line skate having a toolless size adjustment mechanism for adjusting the shoe size of the skate.

BACKGROUND OF THE INVENTION

In recent years, the sport of roller skating and, in particular, in-line roller skating, has enjoyed a tremendous growth in popularity. Generally described, conventional in-line roller skates include an upper boot secured to or integrally formed with a rigid or semirigid base. The base, in turn, is secured along its length, including at heel and toe ends, to a rigid frame. A plurality of wheels is journaled transversely along a longitudinal axis between the sidewalls of the frame.

One segment of the population that has enjoyed the sport of roller skating is children. The costs associated with the sport can be limiting for parents. With the new developments in features and the advancements in materials, high quality in-line skates can be expensive. This expense is compounded when buying in-line skates for children because as children grow, their foot sizes expand, necessitating frequent replacement of the in-line skates.

To address this problem, several skates have been proposed that are size adjustable to accommodate the feet of growing users. One such skate is disclosed in U.S. Pat. No. 5,913,526. The in-line skate includes a skate boot secured to a frame and contains a liner. The frame carries a plurality of wheels. The skate boot includes a heel portion, a cuff, a tongue, and a toe portion. The toe portion is selectively connected to the frame via a bolt, which is received by a nut. The bottom wall of the toe portion includes an elongate slot extending in the longitudinal dimension of the skate through which the bolt passes. When assembled with the heel portion, the toe portion may move along a line of travel that is generally parallel to the longitudinal dimension of the skate, by loosening the nut. This configuration requires a tool, inserted upwardly between the wheels, to adjust the size of the skate, which is inconvenient. Repeated adjustment may lead to stripping of the nut, thus limiting the skate's ability to adjust. During adjustment, the bolt and/or nut may be lost.

SUMMARY OF THE INVENTION

The present invention is directed to an adjustable in-line skate wherein the width of the skate may be selectively modified by the user to achieve a comfortable fit.

In an embodiment of the invention, a size-adjustable in-line skate includes a frame that rotatably supports the wheels of the skate and a base, attached to the frame, which defines a platform and a heel cup. A semirigid toe cup is attachable to the base, the toe cup being adapted to receive the forefoot portion of the skate upper. The toe cup includes a floor portion that is adjacent to the base platform when the toe cup is attached to the base. A slit extends generally longitudinally along most of the length of the floor portion of the toe cup, such that the width of the toe cup may be adjusted by elastically deforming the toe cup.

In an embodiment of the invention, the toe cup slidably engages the floor of the base such that the length of the skate is also adjustable.

In an embodiment of the invention, the width of the toe cup is determined by the adjustable length of the skate.

In an embodiment of the invention, the floor of the base further comprises an upwardly extending tab member and the toe cup further comprises an angled slot that is adapted to slidably receive the tab member, such that slidably adjusting the toe cup relative to the floor of the base will cause the transverse dimension of the slit in the toe cup to change.

In an embodiment of the invention, the base of the skate includes an upwardly extending longitudinal rail having a T-shaped cross section, the rail having a plurality of indents along at least one side, and further, wherein the toe cup includes a T-shaped slot that slidably engages the rail, and the toe cup further comprising a transverse engagement member that selectively engages at least one of the plurality of indents along the rail to lock the toe cup longitudinally with respect to the base.

In an embodiment of the invention, the skate further comprises an ankle cuff that is pivotally attached to the heel cup.

In an embodiment of the skate, the a pair of locking hooks on the toe cup engages a corresponding pair of locking hooks on the base, to preclude the toe cup from inadvertently disengaging from the frame.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
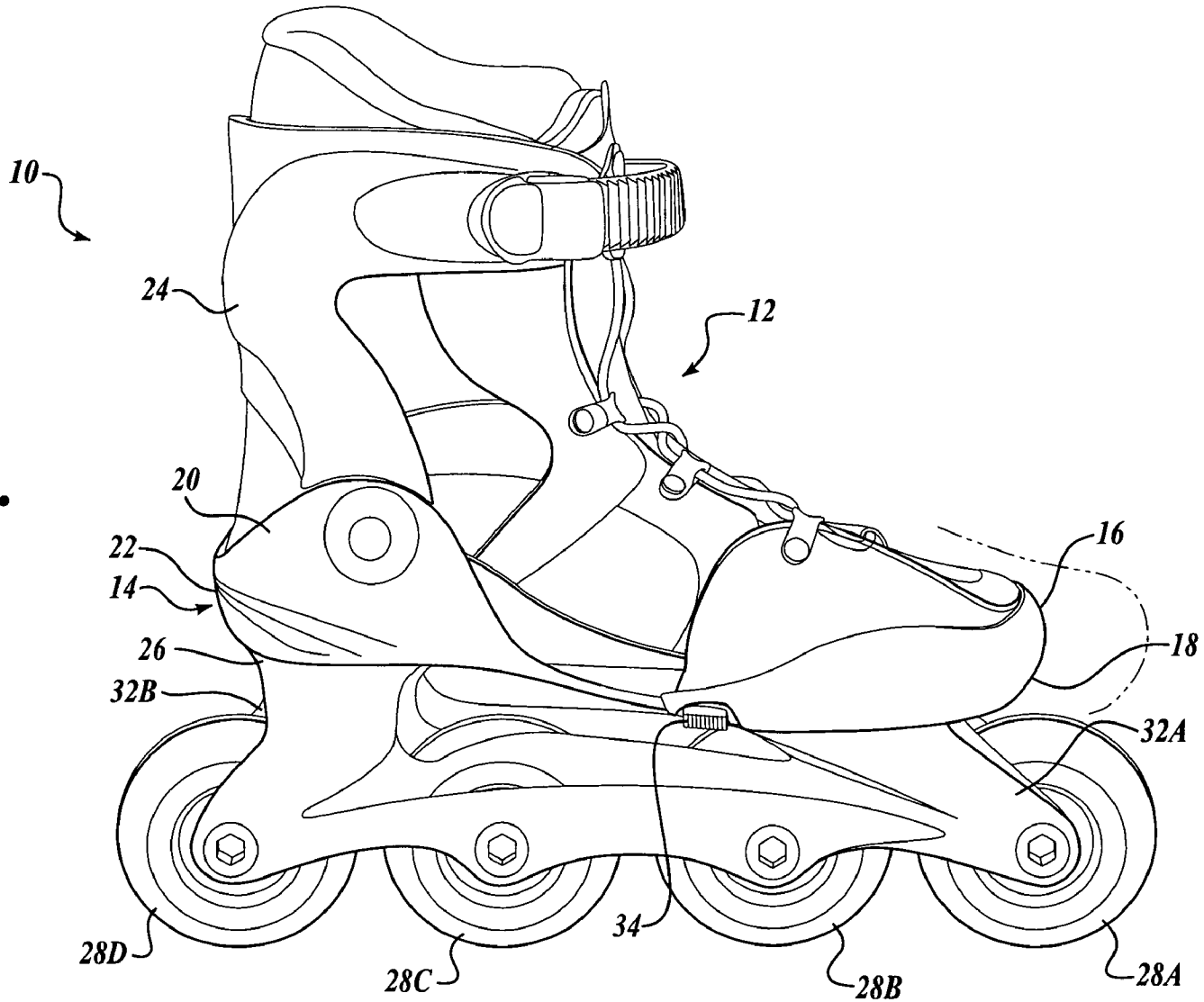
FIG. 1 illustrates an isometric view of a toolless, size-adjustable in-line skate constructed in accordance with aspects of the present invention.

The present invention will now be described with reference to the accompanying drawings where like numerals correspond to like elements. A suitable embodiment of a toolless, size-adjustable in-line skate 10 constructed in accordance with the present invention is illustrated in FIG. 1. The skate 10 includes a substantially nonrigid upper 12 that receives and surrounds a skater's foot and ankle. The upper 12 is mounted on and secured to the upper surface of a base 14. The upper 12 is supported by a substantially rigid external support, including a slidably adjustable toe cup 16 extending upwardly from the toe end 18 of the base 14, a heel cup 20 extending upwardly from the heel end 22 of the base 14, and an ankle cuff 24 pivotally secured to the base 14. The base 14 is mounted to or integrally formed with a frame 26, which extends longitudinally beneath the base 14. A plurality of ground engaging members, such as wheels 28A, 28B, 28C, and 28D, is journaled between first and second opposing longitudinal sidewalls 32A and 32B of the frame 26. The toe cup 16 includes an actuator 34, such as a push-button, which can be depressed or translated so that the slideably adjustable toe cup 16 may slide along the longitudinal axis of the skate to adjust the shoe size of the skate 10.

Suitable materials and construction (except for adjustable aspects) for the nonrigid upper 12 and substantially rigid outer support are disclosed in U.S. Pat. No. 5,437,466, hereby expressly incorporated by reference. Alternatively, an internal support structure can be used with the nonrigid upper, as described in U.S. Pat. No. 6,168,172, hereby expressly incorporated by reference. Further, various components of the nonrigid portions of the support can be modified for a higher degree of rigidity.

Figure 2:
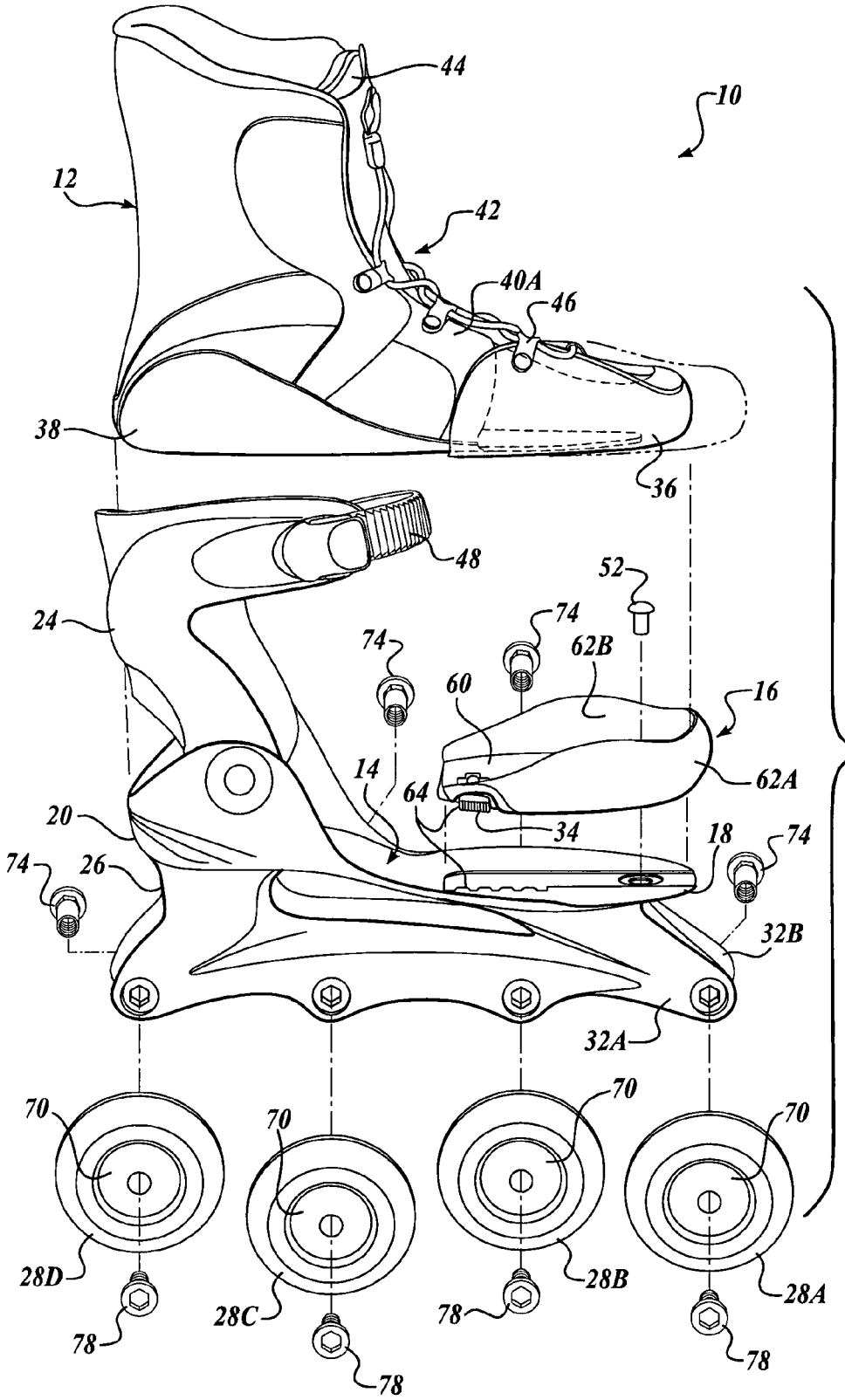
FIG. 2 illustrates a side assembly view of the skate shown in FIG. 1.

Referring to the illustrative embodiment of FIG. 2, the upper 12 includes a toe end 36, a heel end 38, and diametrically opposed sides 40A and 40B that define a vamp opening 42. The toe end 36 is separate from the rest of the upper 12 and, when assembled, overlaps with the sides 40A and 40B. A tongue 44 is fastened to the upper 12, extending upwardly beneath the vamp opening 42. The vamp opening 42 is drawn closed and the soft upper is fitted and drawn about the skater's foot by a lacing system 46. Alternate constructions that do not use a lacing system are within the scope of the invention and will be described below. An ankle cuff strap 48 connected to the ankle cuff 24 may be selectively secured to fasten the cuff 24 about the skater's lower leg, above the ankle cuff 24. The upper 12 may include other components, such as a sole or the like.

Figure 9:
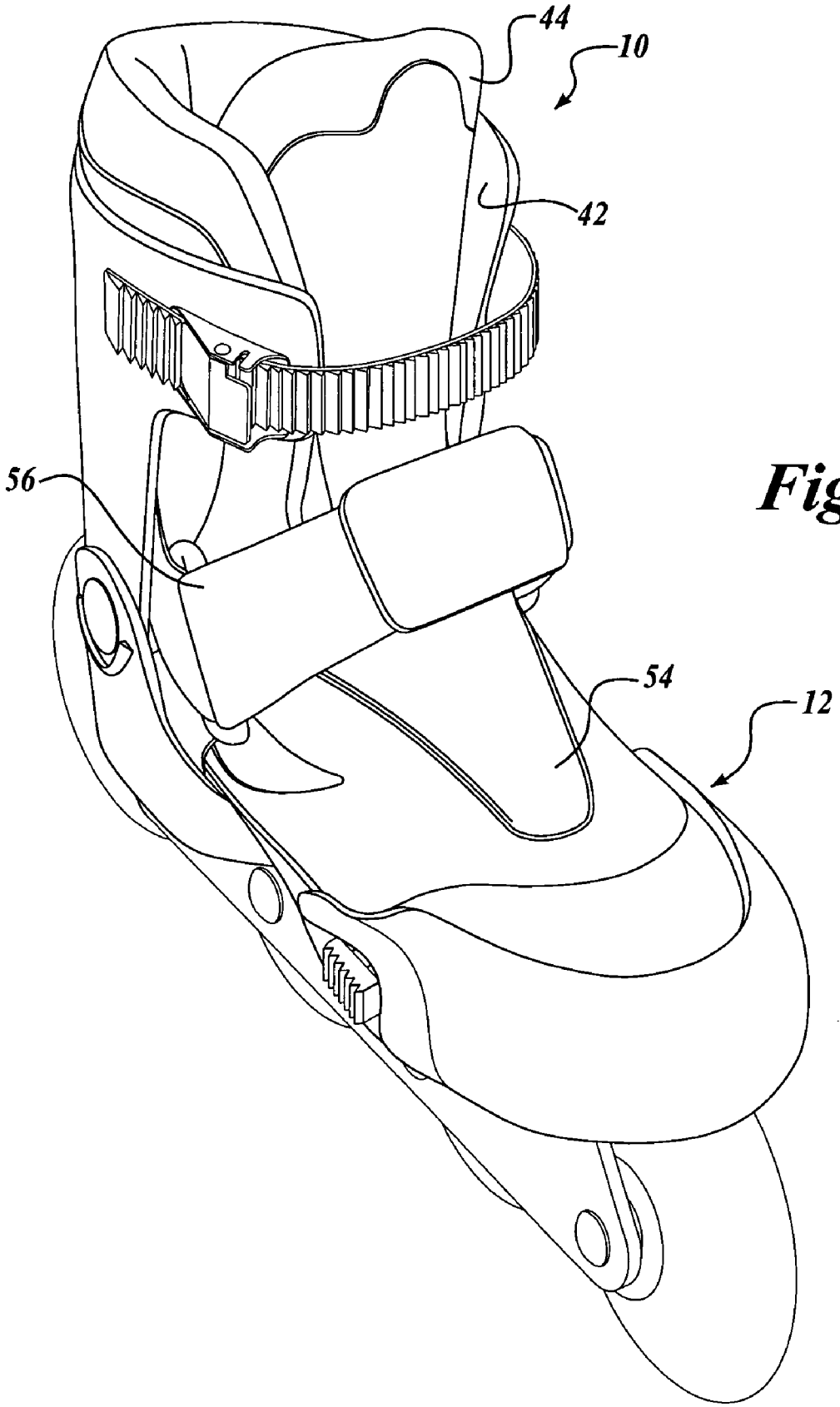
FIG. 9 illustrates an isometric view of another embodiment of a toolless, size-adjustable in-line skate constructed in accordance with aspects of the present invention.

The upper 12 may be drawn closed by an alternative closure system to securely couple the upper to a user's foot. For example, in FIG. 9, an alternative closure system is shown wherein the vamp opening 42 of the upper 12 of skate 10 is drawn closed by an elastic web 54 that extends across a lower portion of the vamp opening 42, overlying the tongue 44. The alternative closure system may further includes an instep strap 56 secured across the upper 12, extending from a lateral side of the heel cup to a medial side of the heel cup, below the ankle. A more detailed description of this particular alternative closure system utilizing an elastic web is found in co-pending U.S. patent application Ser. No. 09/847,959, entitled FAST ENTRY ELASTIC VAMP CLOSURE SKATE, to Bennett, and filed May 2, 2001, the disclosure of which is hereby incorporated by reference.

Referring to FIG. 2, the skate 10 will now be described in more detail. The upper 12 of the skate 10 is constructed of a majority of substantially nonrigid materials, and is supported by a rigid, or at least semirigid, external support. The substantially nonrigid upper 12 is suitably constructed from flexible materials such as fabric, leather, flexible plastics, and cushioning materials such as fiber, fleece, batting or elastomeric foams. The toe end 36 of the upper 12 is securely fastened to the toe cup 16, such as by riveting, stitching, bonding, using bolts or the like. The toe cup 16 includes a bottom wall 60 and medial and lateral sidewalls 62A and 62B that extend upwardly around the toe end 36 of the upper 12. The toe cup 16 is slideably coupled to the toe end 18 of the base 14 with a fastener 52, such as a rivet, bolt, screw or the like, that will be described in more detail below. The toe cup 16 includes an actuator 34 operatively connected within the medial sidewall 62A and is a part of a size adjustment mechanism 64 for adjusting the shoe size of the skate. The actuator 34 and the size adjustment mechanism 64 will be described in more detail below.

The heel end 38 of upper 12 is securely fastened to the base 14, such as by riveting, bonding, stitching, using bolts or the like, and is supported by a rigid heel cup 20. The rigid heel cup 20 may be integrally formed with the base 14 or secured to the base 14, and extends upwardly therefrom on the lateral and medial sides of the heel end 38 of the upper 12. The ankle cuff 24 is pivotally secured to the upper lateral and medial sides of the heel cup 20, to pivot forwardly and rearwardly at about the natural pivot axis of the ankle. The ankle cuff 24 wraps the rear, lateral, and medial sides of the leg, above the ankle. The ankle cuff strap 48 includes a quick release ratcheting buckle assembly to selectively secure and tighten the cuff about the leg.

The upper 12 of the skate 10 extends continuously upward from the base to above the upper edge of the ankle cuff 24. However, it should be apparent that the present invention is also suitably used with skates having an upper that is discontinuous, having a separate cuff pad, or that terminates below the ankle.

Still referring to FIG. 2, the frame 26 is mounted below or integrally formed with the base 14, and extends downwardly from the base 14. The frame 26 includes first and second opposing longitudinal sidewalls 32A and 32B. The frame 26 carries four wheels, 28A, 28B, 28C, and 28D, journaled between the opposing sidewalls 32A and 32B. Each wheel includes a center hub 70 and bearing assembly (not shown) that are mounted rotatably on an axle 74 that is inserted through aligned apertures 76 of the sidewalls 32A and 32B, and that are retained by cap screws 78. The frame 26 can be formed from any suitable rigid material, such as aluminum, titanium, other metals and alloys, engineering thermoplastics, and fiber-reinforced thermoplastics or thermosetting polymers. An optional brake member may be fastened to the frame, rearward of the wheel 28D, which is well known in the art.

Figure 4:
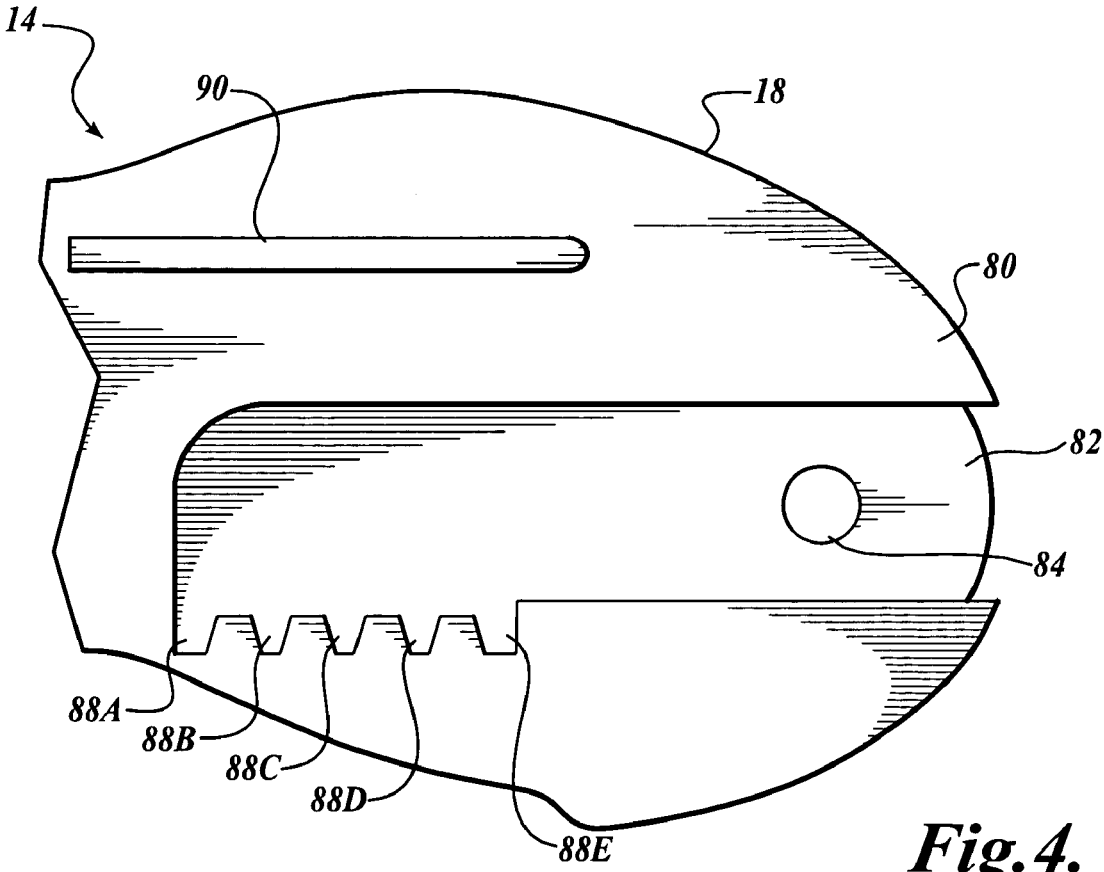
FIG. 4 illustrates a top view of the toe end of the base shown in FIG. 2.

In accordance with an aspect of the present invention, the skate 10 includes a size adjustment mechanism 64 having an actuator 34 for adjusting the shoe size of the skate 10, which was briefly discussed above and will now be described in greater detail with reference to FIGS. 4–9. As shown in FIG. 4, the toe end 18 of the base 14 extends as a generally oval-shaped member having a substantially flat top surface 80 suitably sized for supporting the slideably adjustable toe cup. The toe end 18 includes an elongate, generally rectangular recess or slot 82 open to the top surface thereof, and extending in the longitudinal dimension of the skate for receiving a boss of corresponding shape located at the bottom surface of the toe cup. The slot 82 includes an aperture 84 on the bottom surface of the slot 82, and is positioned at the forward portion of the slot 82 and extends through the base 14. The aperture 84 is of a suitable shape and size to receive a fastener 52, such as a rivet (FIG. 2), to securely couple the toe cup to the base 14.

Positioned at the rear portion of the slot 82 and formed into the medial side thereof is a series of detent notches 88A, 88B, 88C, 88D, and 88E. In one embodiment, the detent notches form teeth that are tapered in shape and protrude horizontally inward toward the centerline of the slot 82. While shown in FIG. 4 as tapered in shape, the detent notches can be of any suitable size or geometry without departing from the scope of the present invention. The detent notches 88A, 88B, 88C, 88D, and 88E are operable to engage or mesh with correspondingly shaped teeth on the actuator to form the indexing size adjustment mechanism, the operation of which will be described in more detail below. In the embodiment shown, five detent notches are formed in the base. However, it will be appreciated that any number of detent notches may be formed in the base. The top surface 80 of the toe end 18 further includes an elongate rib member 90 that extends substantially parallel with the slot 82. The elongate rib member 90 mates with and slides within a slot of corresponding shape within the bottom wall of the toe cup to provide a guide mechanism that prevents rotation of the toe cup as it slideably translates on the toe end 18.

Figure 5:
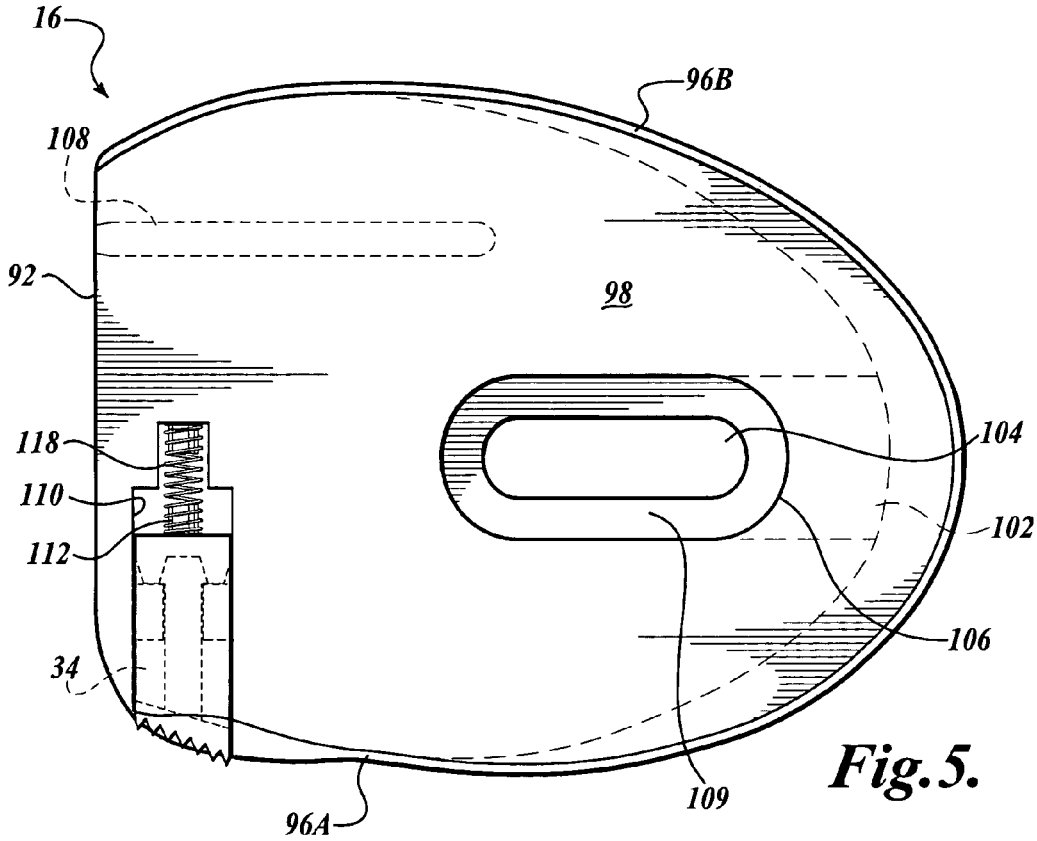
FIG. 5 illustrates a top view of the toe cup shown in FIG. 2.
Figure 6:
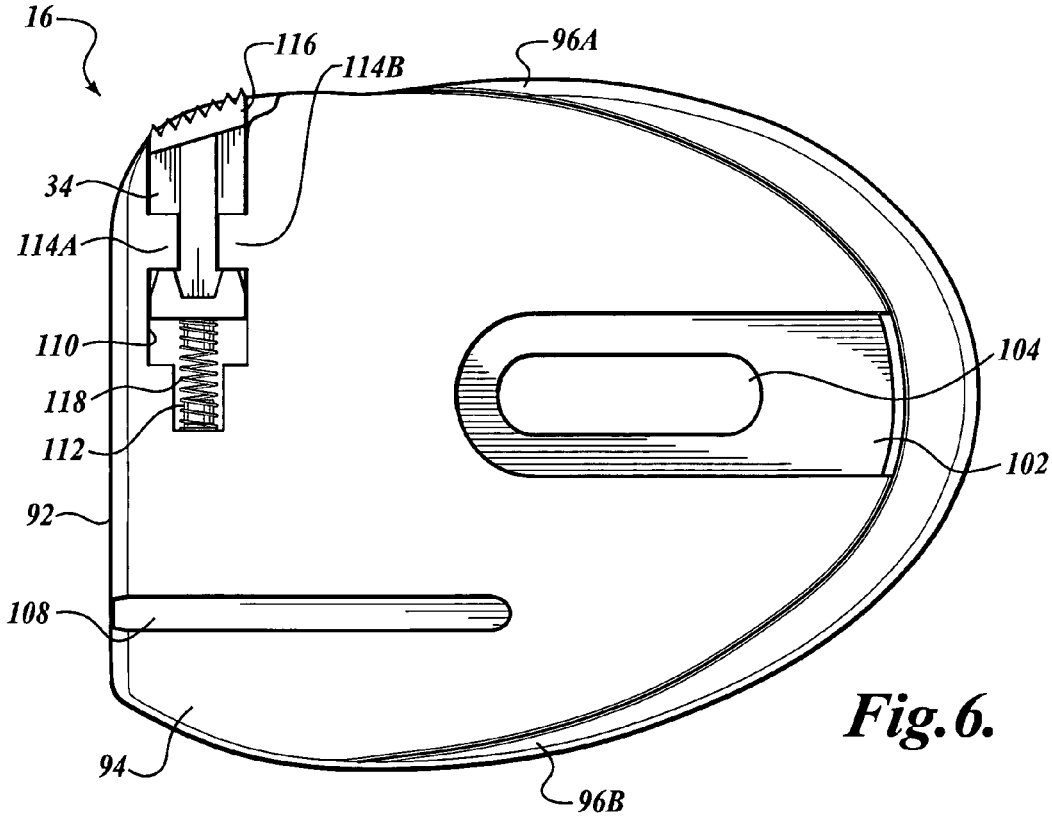
FIG. 6 illustrates a bottom view of the toe cup shown in FIG. 2.

Referring now to FIGS. 5 and 6, the toe cup 16 includes a bottom wall 92 having a substantially flat bottom surface 94 for slideably engaging with the top surface 80 of the base 14. The toe cup 16 also includes medial and lateral sidewalls 96A and 96B that extend upwardly from the bottom wall 92 to form a cavity 98. The cavity 98 is of a suitable dimension to receive the forefoot of a skater. While shown as a toe cup, it will be appreciated that the slideable support member can be a toe member such as a substantially flat plate or bottom wall 92. In either case, the bottom wall 92 of the toe cup 16 includes a longitudinally disposed slot 108 open to the bottom surface 94 for mating with the elongate rib member 90 of the base 14 described above. Extending downwardly from the bottom surface 94 of the toe cup 16 is a generally rectangular shaped boss 102 with rounded edges. The boss 102 extends lengthwise in the longitudinal dimension of the skate and is suitably shaped and positioned at the forward end of the bottom surface 94 to be slideably received within the slot 82 of the base 14 (FIG. 4). The boss 102 and corresponding slot 82 of the base form a guide mechanism which, along with the guide mechanism described above, comprised of the slot 108 and the elongate rib member 90, prevents rotation of the toe cup 16 as it slideably translates on the toe end of the base 14.

The boss 102 is provided with an elongated slot 104 open to the bottom surface and also extending in the longitudinal dimension of the skate for passing a fastener 52, such as a rivet, when the toe cup 16 is slideably translated with respect to the base 14. As best shown in FIG. 5, the top surface of the bottom wall 92 includes an elongate slot 106 formed by downwardly descending sidewalls of the boss that is concentric with slot 104. The slot 106 is similar in shape, but larger in size, than slot 104 to form a shoulder 109 for supporting the head of the fastener 52 as the slots 104 and 106 pass the fastener when the toe cup 16 is slidably translated with respect to the base. The fastener 52 can be removable such as a bolt or screw, or can be nonremovable or permanent, such as a rivet. In either case, the fastener 52 securely retains the toe cup on the base during adjustment.

Still referring to FIGS. 5 and 6, the bottom wall 92 includes a horizontally disposed slot 110, which is transverse to the longitudinally dimension of the skate. The slot 110 is suitably dimensioned to receive the actuator 34 of the size adjustment mechanism in a slideable fashion. The slot 110 also includes a tab portion 112 integrally formed at its innermost surface for receiving a biasing member 118, such as a spring. Integrally formed in the bottom wall 92 are two diametrically opposed tabs 114A and 114B for supporting the actuator as it slides horizontally within the slot 110. The rear portion of the medial sidewall 96A includes an aperture 116 for allowing a portion of the actuator to protrude through the medial sidewall 96A.

Figure 3:
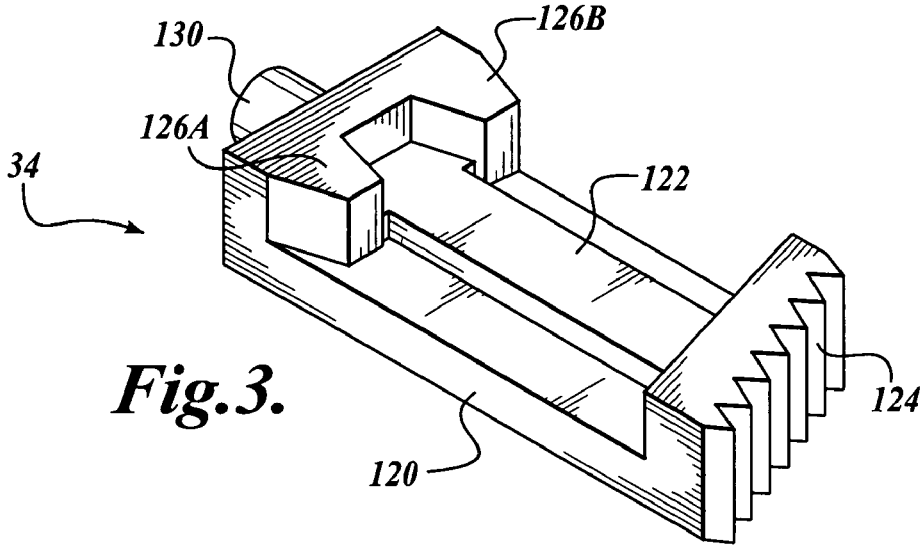
FIG. 3 illustrates an isometric view of the actuator shown in FIG. 2.

Referring now to FIG. 3, the actuator 34 of the size adjustment mechanism will be described in more detail. The actuator 34 is constructed as a unitary body having a generally T-shaped cross section. The actuator includes an upper member 120 and a lower member 122 extending transversely from the upper member 120 to form the T-shaped actuator. At one end, the actuator 34 includes a face 124, preferably grooved and suitably sized for engagement with the thumb or forefinger of a skater. The actuator 34 includes substantially and parallel upper and lower surfaces, spaced to slidably seat within the slot 110, flush with the top surface of the toe cup 16. The lower member 122 extends from the upper member 120 in a downward direction between the opposed tabs 114A, 114B that support the actuator 34 and guide the horizontal translation of the actuator 34. Two engagement members or teeth 126A and 126B are disposed on the opposite end of the actuator 34. The teeth are preferably tapered in geometry and oriented toward the face 124 of the actuator 34. It will be appreciated that the size and geometry of the teeth 126A, 126B correspond to the size and geometry of the detent notches 88A–88E, so that the teeth may properly mesh with the detent notches. The actuator 34 also includes a tab 130 connected to the rearward surface of the actuator 34 that engages one end of the biasing member 118 (FIGS. 5 and 6). The biasing member 118 biases the actuator 34 outwardly toward the medial sidewall of the toe cup so that the teeth 126A and 126B selectively mesh with the detent notches 88A–88E of the base 14.

Figure 7:
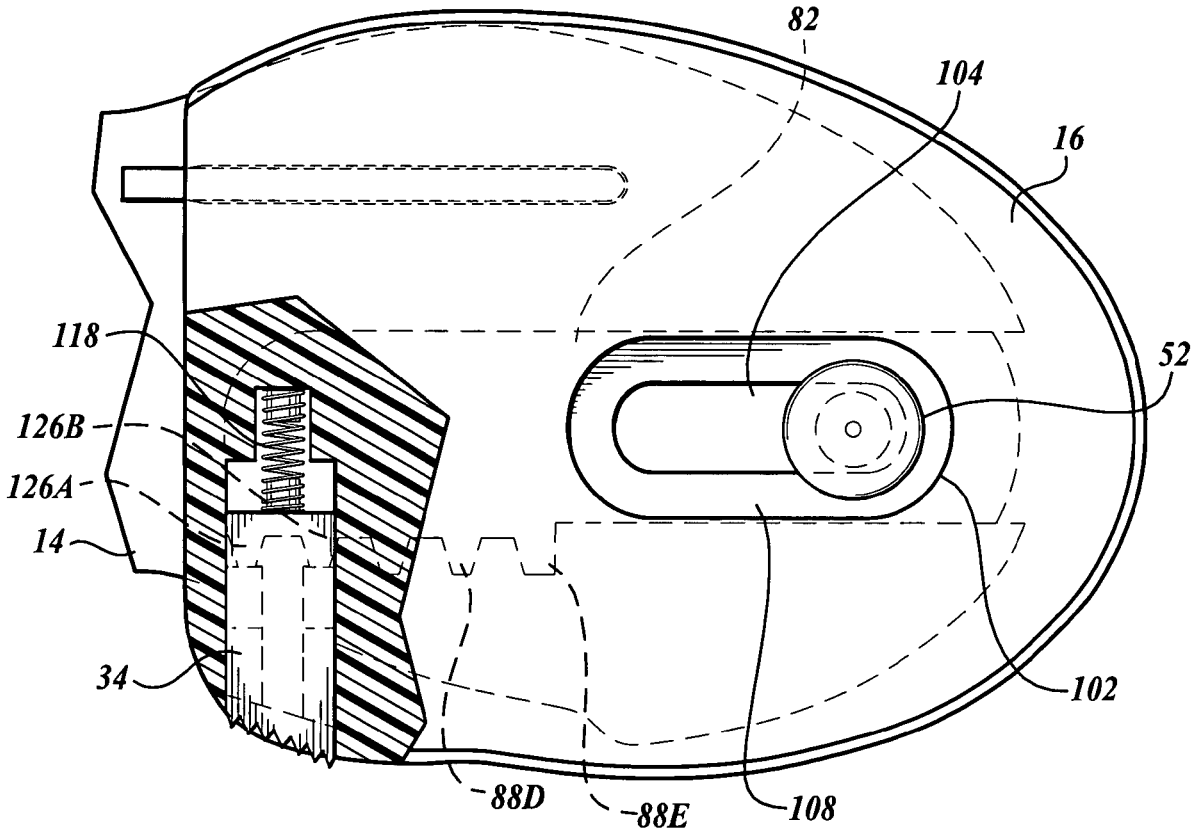
FIG. 7 illustrates a top cut-away view of the toe cup slideably mounted to the base in a fixed position.

The operation of the size adjustment mechanism 64 will now be described in detail with reference to FIGS. 7 and 8. FIG. 7 depicts the toe cup 16 fixed at a desired longitudinal position relative to the heel end of the base (not shown). The toe cup 16 is supported by the top surface of the base 14, whereby the boss 102 is nested within the elongate slot 82 of the base 14. The toe cup 16 is securely fastened to the base 14 via the fastener 52, which is slideably received within the slot 104 with the head portion of the fastener 52 supported by the shoulder 108. The actuator 34 is biased by the biasing member 18 outward such that the teeth 126A, 126B located on the bottom of the actuator 34 mesh with two of the detent notches 88A–88E formed within the slot 82 (FIG. 7 shows teeth 126A, 126B meshing with detent notches 88A, 88B). In this position, a skater may skate without the toe cup 16 sliding relative to the base 14.

Figure 8:
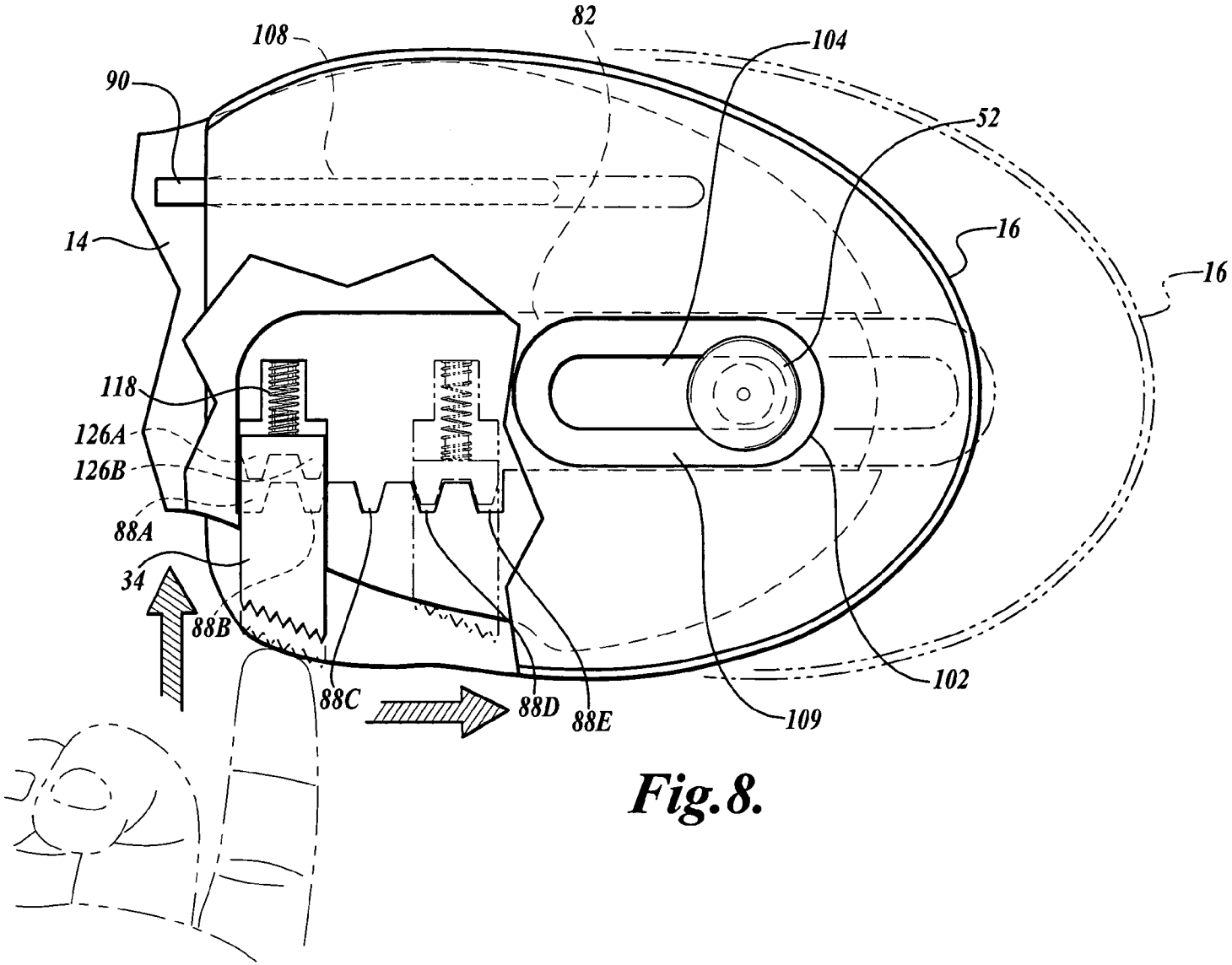
FIG. 8 illustrates a top cut-away view of the actuator being depressed and disengaged with the detents, and the toe cup translated in the longitudinal dimension to a second position.

To change the size of the skate so that the skate may fit a skater with a larger foot, the skater may translate the actuator 34 by depressing the actuator inward with her finger, which is depicted in FIG. 8. As shown in FIG. 8, the actuator 34 is linearly translated in the horizontal plane against the force of the biasing member 118 to disengage the teeth 126A and 126B of the actuator 34 from the detent notches 88A–88E of the slot 82. In this position, the toe cup 16 may slide or translate in the longitudinal dimension relative to the heel end of the base (note shown) to increase the size of the cavity formed by the upper so that the upper 12 may receive a larger foot of a skater. The toe cup 16 and actuator 34 travel together during adjustment. In the embodiment shown, this can be easily done by grasping the toe cup 16 with one hand and, in one movement, depress the actuator 34 with the thumb and translate the toe cup 16.

As the toe cup 16 translates to a final or second desired longitudinal position shown in phantom in FIG. 8, the boss 102 and elongate rib member 90 slide relative to the slots 82 and 108, respectively, preventing the toe cup 16 from rotating. Once the toe cup 16 is in a desired longitudinal position relative to the heel end of the base, the actuator 34 may be released. The biasing force of the biasing member 118 linearly translates the actuator 34 outwardly, and the skater may adjust the toe cup 16 until the teeth 126A, 126B mesh with the desired detent notches 88A–88E, as discussed above. The tapered shape of the teeth on the actuator 34 guide the actuator into locking engagement when the actuator 34 is released.

Figure 10:
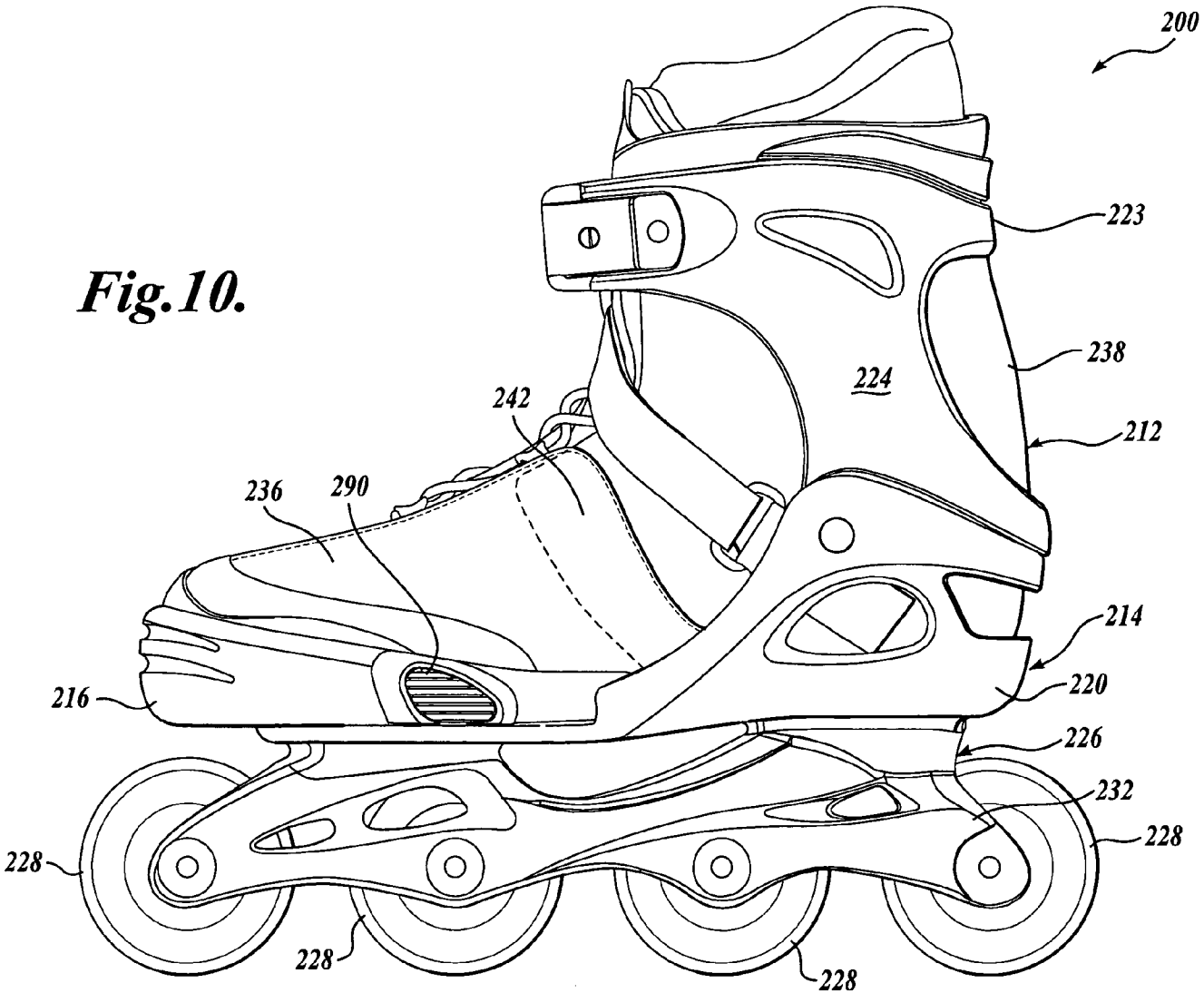
FIG. 10 is a side view of an in-line skate according to another embodiment of the present invention, wherein both the length and the width of the in-line skate are adjustable.

Referring now to FIG. 10, another embodiment of an adjustable in-line skate 200 is shown, wherein both the width and the length of the skate 200 are adjustable, as discussed in detail below. This skate 200 includes a frame 226 having parallel sidewalls 232 (one visible in FIG. 10) that rotatably supports a plurality of wheels 228. A base 214 is fixedly attached to the frame 226. A heel cup 220 is disposed at the rearward end of the base 214, and a toe cup 216 is disposed at the forward end of the base 214. An ankle cuff 224 is pivotally attached to the heel cup 220. The ankle cuff 224 includes a strap 223 and/or other attachment mechanism for securing the skate 200 about the user's ankle. An upper 212, for receiving a user's foot (not shown), is attached to the base 214. In this embodiment, the upper 212 includes a toe portion 236 and a separable heel portion 238 that slidably engage the toe portion 236.

Figure 11:
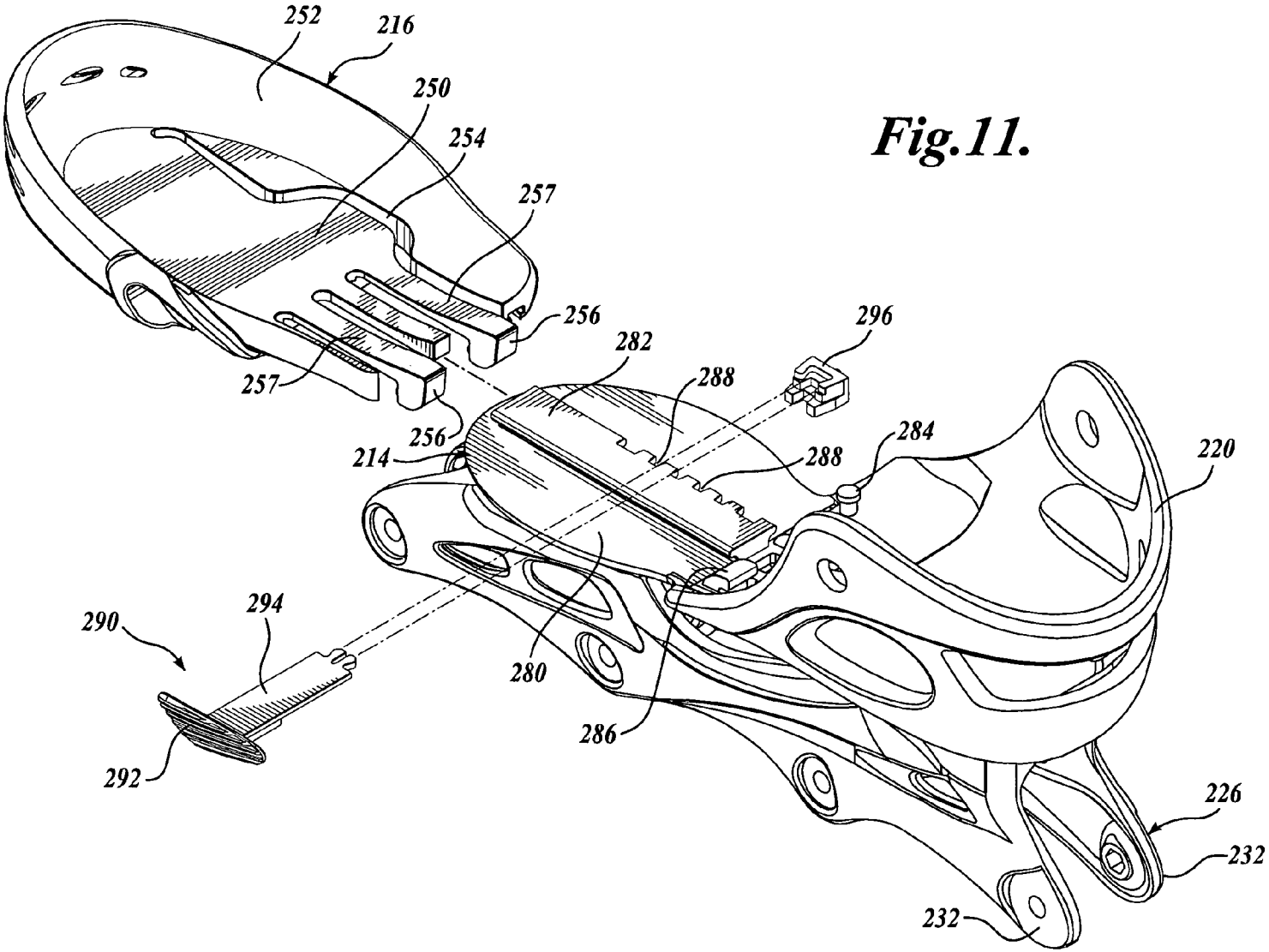
FIG. 11 is an isometric, exploded view of the base and toe cup of the in-line skate shown in FIG. 10.
Figure 12:
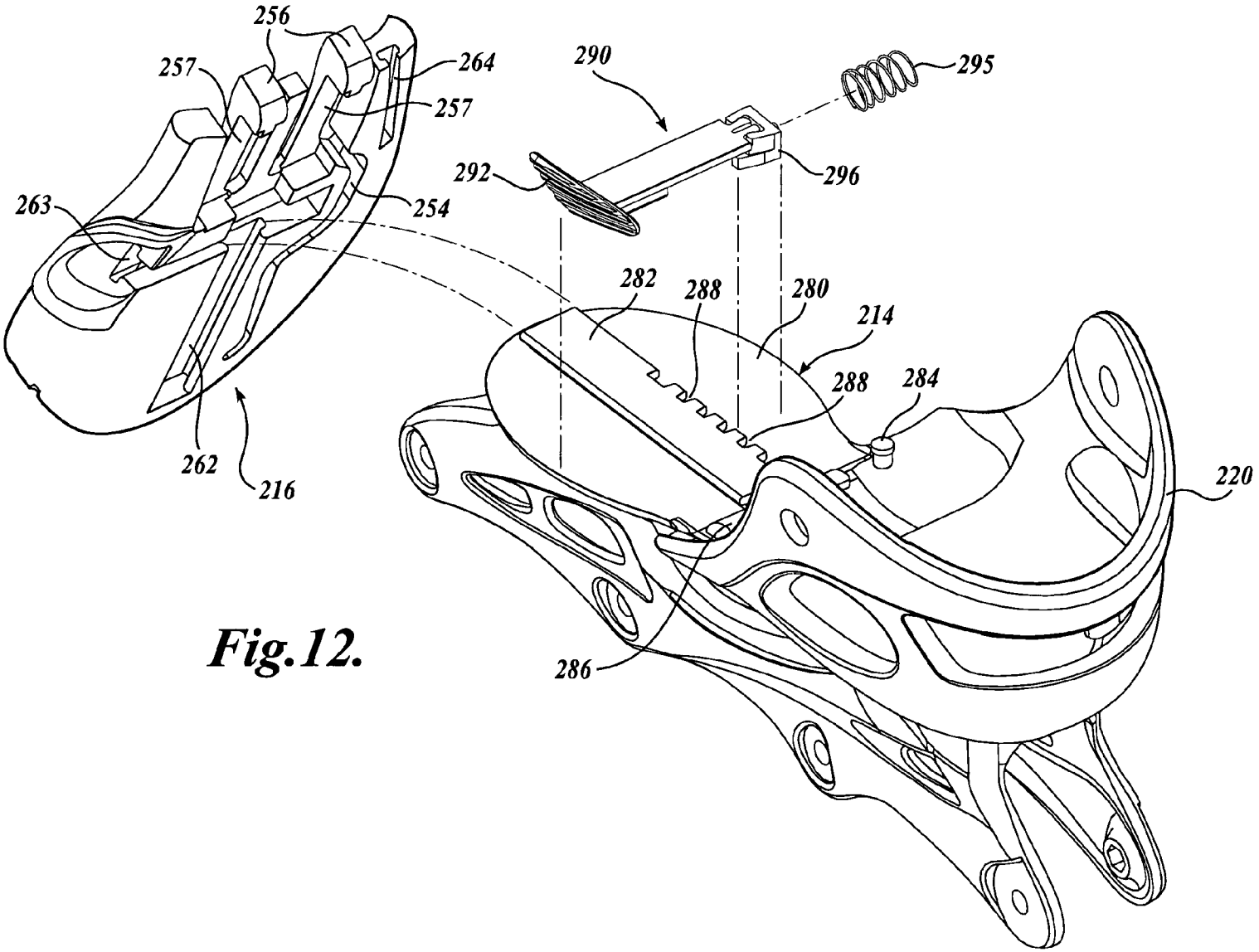
FIG. 12 is another isometric, exploded view of the base and toe cup of the in-line skate shown in FIG. 10, showing the bottom of the toe cup.

Refer now to FIGS. 11 and 12, which show the frame 226, base 214, and toe cup 216 in exploded views. The base 214 includes the heel cup 220, which may be formed integrally with the base 214, and a platform portion 280. A T-shaped rail 282 extends upwardly from the platform portion 280. The rail 282 includes a number of locking detents 288 along one side. A T-shaped guide tab 284 extends upwardly from a rearward end of the platform 280, and a pair of first hook members 286 (one visible in FIG. 11) also extends upwardly from the rearward end of the platform 280. The function of the rail 282, guide tab 284, and first hook members 286 is explained below.

The toe cup 216 is separable from the base 214 and slidably engages the base 214 such that the length of the skate 200 may be selectively adjusted. The toe cup 216 includes a floor portion 250 having a peripheral wall 252 extending upwardly about a portion of the periphery of the floor portion 250. An elongate slit 254 extends from a back end of the toe cup 216, forwardly for most of the length of the toe cup 216. The toe cup 216 is made from a sufficiently elastic material that the width of the toe cup 216 may be elastically adjusted by increasing or decreasing the transverse dimension (i.e., the variable width) of the elongate slit 254, as discussed below. The rearward end of the toe cup 216 includes a pair of second hook members 256, that is adapted to engage the first hook members 286 on the base 214. As shown in FIG. 11, the second hook members 256 extend on narrow, elongate beams 257 that act as springs, to permit the second hook members 256 to elastically bend upwardly, to permit the second hook members 256 be positioned to engage the first hook members 286.

As seen most clearly in FIG. 12, wherein the toe cup 216 has been rotated to reveal its underside, the toe cup 216 includes a first T-shaped channel 262 along the underside of the toe cup 216. The first T-shaped channel 262 is sized and positioned to slidably engage the T-shaped rail 282 on the base 214, such that the toe cup 216 is attachable to the base 214. A locking assembly 290 having a button 292, a T-shaped arm 294, and a lock tab 296, is slidably retained in a second T-shaped channel 263 disposed transversely in the underside of the toe cup 216. The locking assembly 290 is biased outwardly—that is, toward the locked position—by a biasing member, such as a spring 295.

A third T-shaped channel 264 on the underside of the toe cup 216 is located near the slit 254, and is sized and shaped to slidably engage the T-shaped guide tab 284 on the base 214. The third T-shaped channel 264 is disposed at an angle, with respect to the first T-shaped channel 262. It will be apparent to persons of skill in the art, therefore, that as the toe cup 216 is slidably adjusted longitudinally along the rail 282, the fixed guide tab 284 will exert a transverse force through the third T-shaped channel 264, tending to increase or decrease the transverse dimension of the slit 254. Longitudinally adjusting the toe cup 216 by sliding it along the rail 282, therefore, will increase or decreasing the overall width of the toe cup 216. The third T-shaped channel 264 is oriented at an angle such that the width of the toe cup 216 will increase as the length of the skate is increased—that is, as the toe cup 216 is moved generally away from the heel cup 220.

It will be appreciated that when the toe cup 216 is captured by the base 214 by slidably inserting the rail 282 into the first T-shaped channel 262, the toe cup 216 may be slid backward far enough to cause the second hook members 256 to be disposed rearwardly of the first hook members 286. The first and second hook members 286, 256 are positioned to engage when a desired maximum extent of forward travel for the toe cup 216 has been achieved, thereby preventing the toe cup from inadvertently disengaging the base 214.

As discussed further below, the user can adjust the skate 200 by depressing the button 292 of the locking assembly 290 against the biasing force of the spring 295, thereby releasing the lock tab 296 from the locking detents 288 on the rail 282. The user can then push the toe cup 216 slidably along the rail 282 to the desired length and width, and release the button 292, permitting the lock tab 296 to engage the closest locking detents 288.

Figure 13:
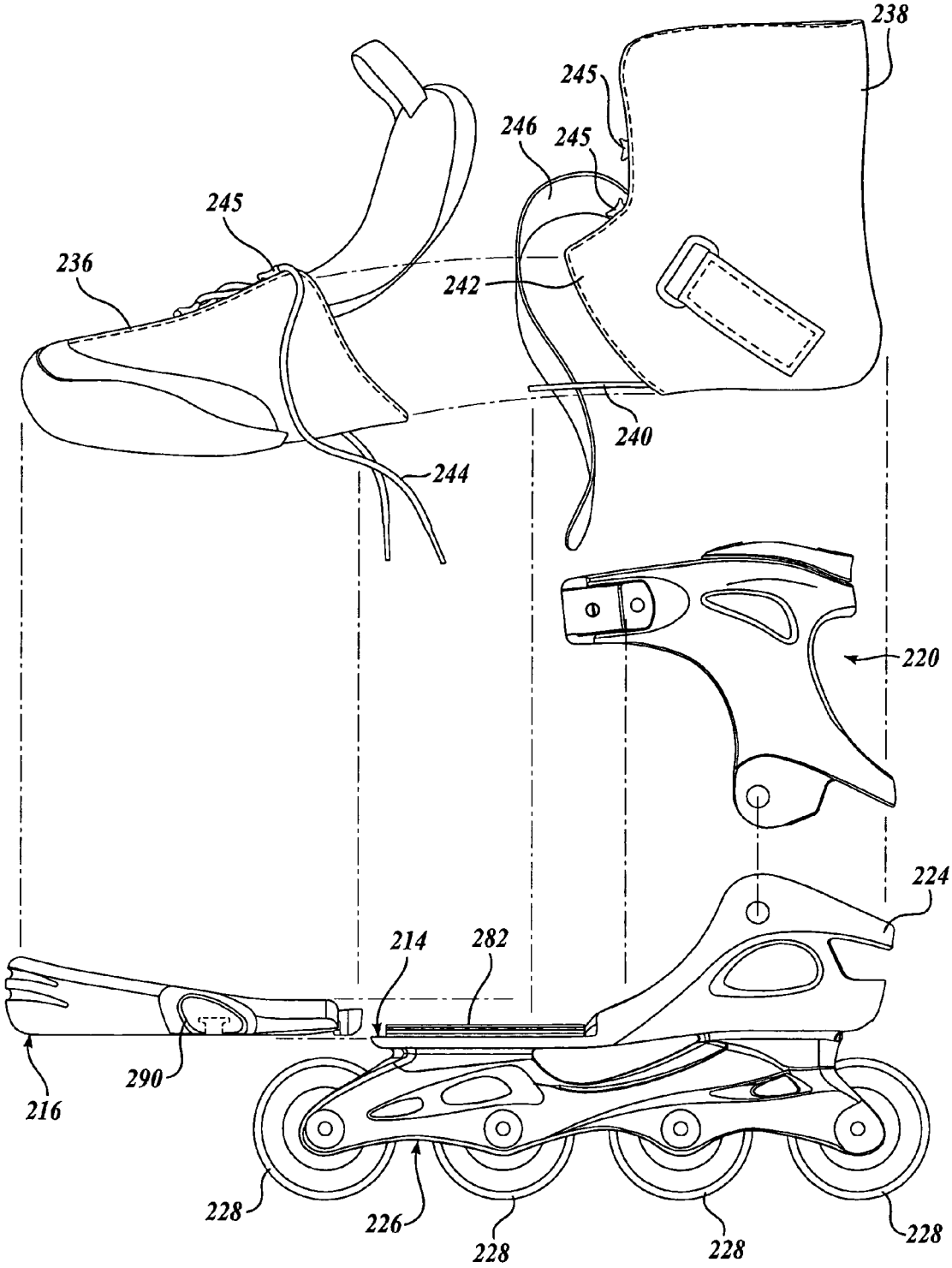
FIG. 13 is a partially exploded side view of the in-line skate shown in FIG. 10.

Referring now to FIG. 13, which is a partially exploded view of the skate 200, it can be seen that the toe portion of the upper 236 is attached to the toe cup 216, and the separable heel portion of the upper 238 is attached to the base 214. The attachment of the upper portions 236, 238 may be by any suitable method, including bonding or attachment hardware. In a hard-shell type skate, the toe portion of the upper 236 may be formed integrally with the toe cup 216, and/or the heel portion of the upper 238 may be formed integrally with the base 214 and/or the ankle cuff 220. In one presently preferred embodiment of the invention, the toe and heel portions of the upper 236, 238 are relatively flexible and breathable members, to provide a comfortable experience for the user.

The toe portion of the upper 236, apart from being only a portion of the upper, may be of conventional construction—for example, utilizing a slip lasting construction. The toe portion of the upper 236 may also include a slit (not shown) on the sole that generally corresponds to the slit 254 (FIG. 11) in the toe cup 216, such that the toe portion of the upper 236 may easily accommodate the variable width of the toe cup 216. The heel portion of the upper 238, again apart from being only a portion of the upper, may be of conventional construction—for example, utilizing a board lasting construction. The heel portion of the upper 238 includes a relatively stiff sole extension portion 240 that slidably extends into the toe portion of the upper 236. The heel portion of the upper 238 also includes oppositely disposed wing portions 242 (left wing visible in FIG. 13) that slidably fit within the toe portion of the upper 236, providing a comfortable, adjustable fit completely surrounding the foot of the user, as seen most clearly in FIG. 10. The toe portion of the upper 236 and/or the heel portion of the upper 238 may further include a fastening mechanism, such as a lace 244 and lace keepers 245, and the heel portion of the upper 238 may similarly include a fastening mechanism, such as an adjustable strap 246.

Figure 14A:
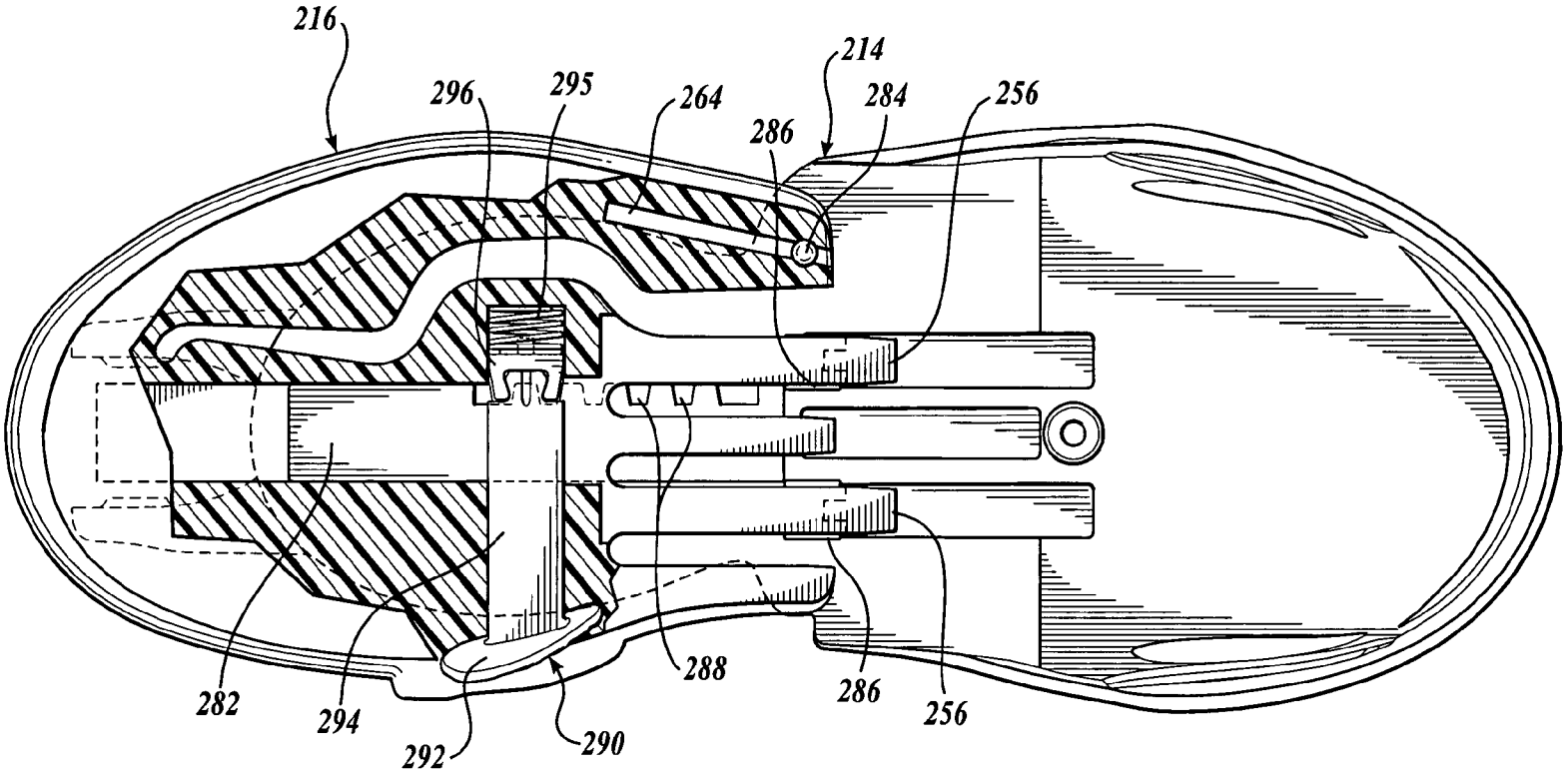
FIGS. 14A, 14B, and 14C are partially cut-away plan views of the base and toe cup of the in-line skate shown in FIG. 10, showing the steps to adjust the size of the in-line skate.
Figure 14B:
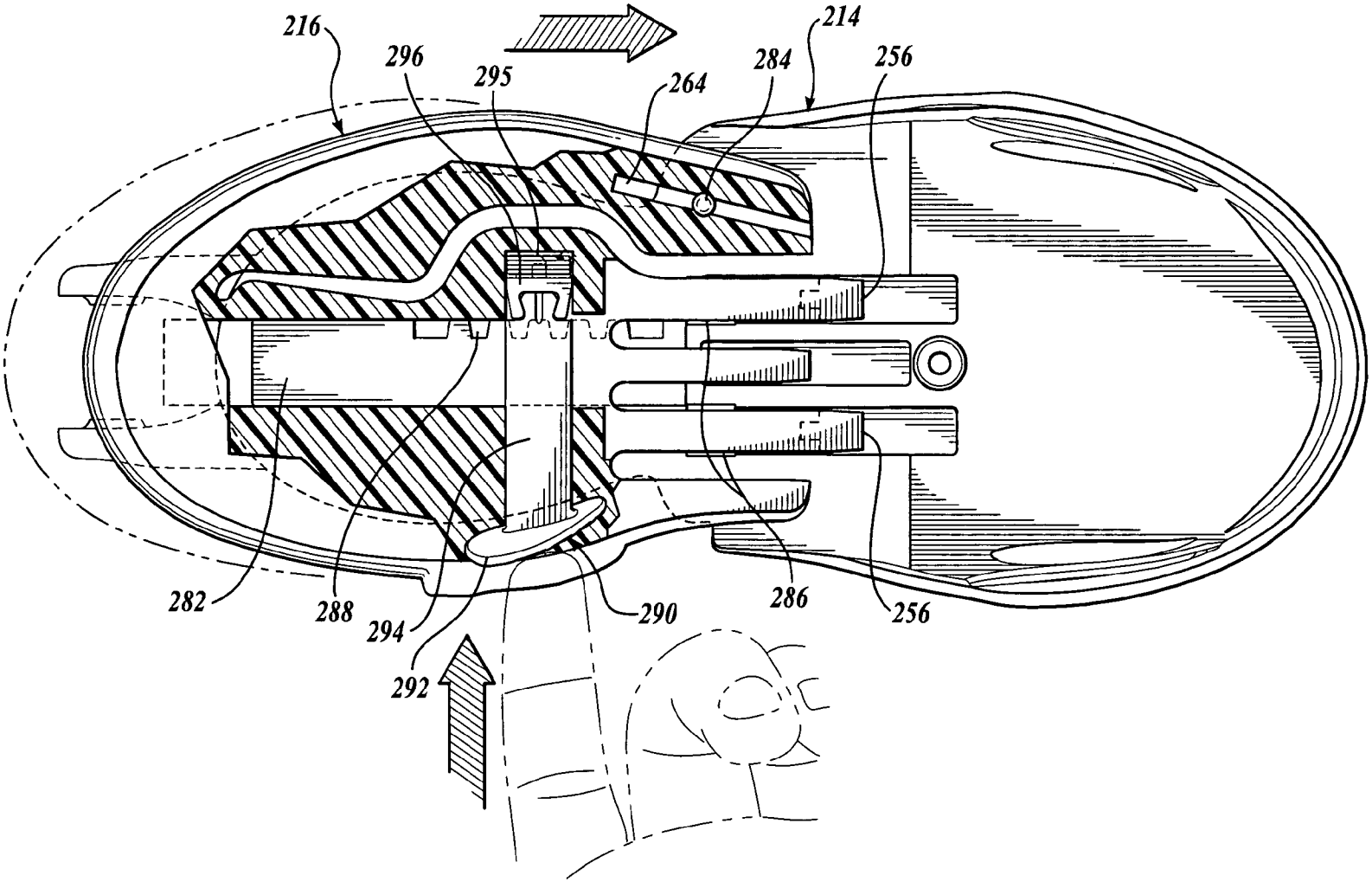
Figure 14C:
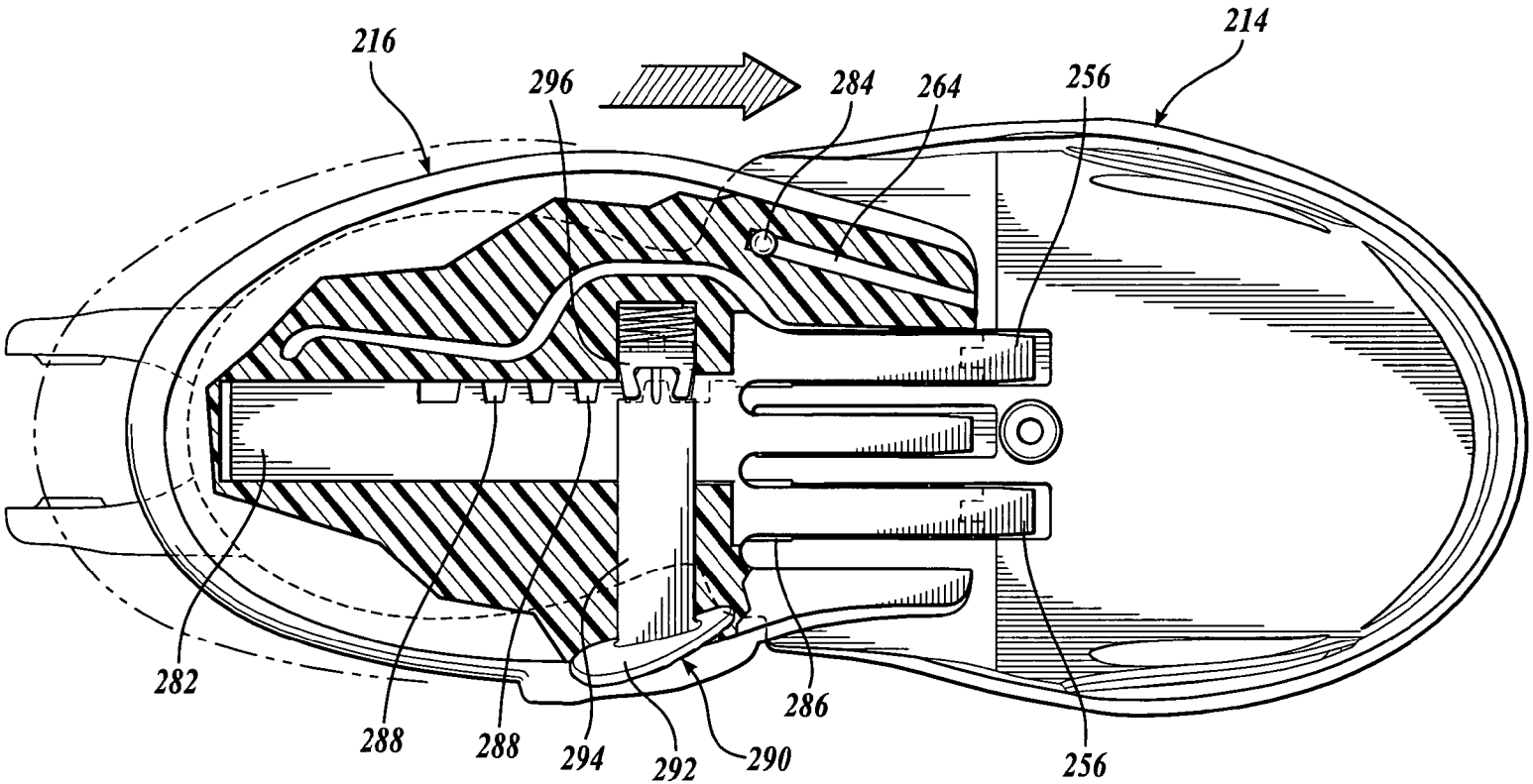

Adjustment of the length an width of the skate 200 will now be describe with reference to FIGS. 14A–14C, which illustrate the adjustment steps. In FIG. 14A, the base 214 and partially cut-away toe cup 216 are shown with the toe cup 216 in the furthest extended position—that is, with the lock tab 296 engaging the forwardmost locking detents 288 on the rail 280. As shown in FIG. 14B, the user depresses the button 292 of the locking assembly 290 to push the lock tab 296 out of engagement with the locking detents 288, and slidably moves the toe cup 216 rearwardly. The guide tab 284, captured in the third T-shaped channel 264 in the toe cup 216 will cause the toe cup 216 to elastically flex, changing the transverse dimension of the slit 254 such that the overall width of the toe cup 216 changes (decreases, in this example). The user then releases the button 292, allowing the lock tab 296 to lock into place with the nearest locking detents 288. It will be appreciated from FIG. 14A that the second hook members 256 on the toe cup 216 are positioned to engage the first hook members 286 on the base 214 to prevent inadvertent disengagement of the toe cup 216 from the base 214.

Although the disclosed embodiments of the skate 200 show the rail 282 and guide tab 284 disposed on the base 214, and the channels 262, 263, 264 and locking assembly 290 disposed in the toe cup 216, it will be readily apparent that the present invention may be practiced, for example, with appropriate pairs of these elements reversed. For example, the guide tab 284 may alternatively be disposed on the bottom of the toe cup 216, with the corresponding channel 264 disposed in the base 214. Other similar and obvious variations will be immediately apparent to persons of skill in the art.

Figure 15A:
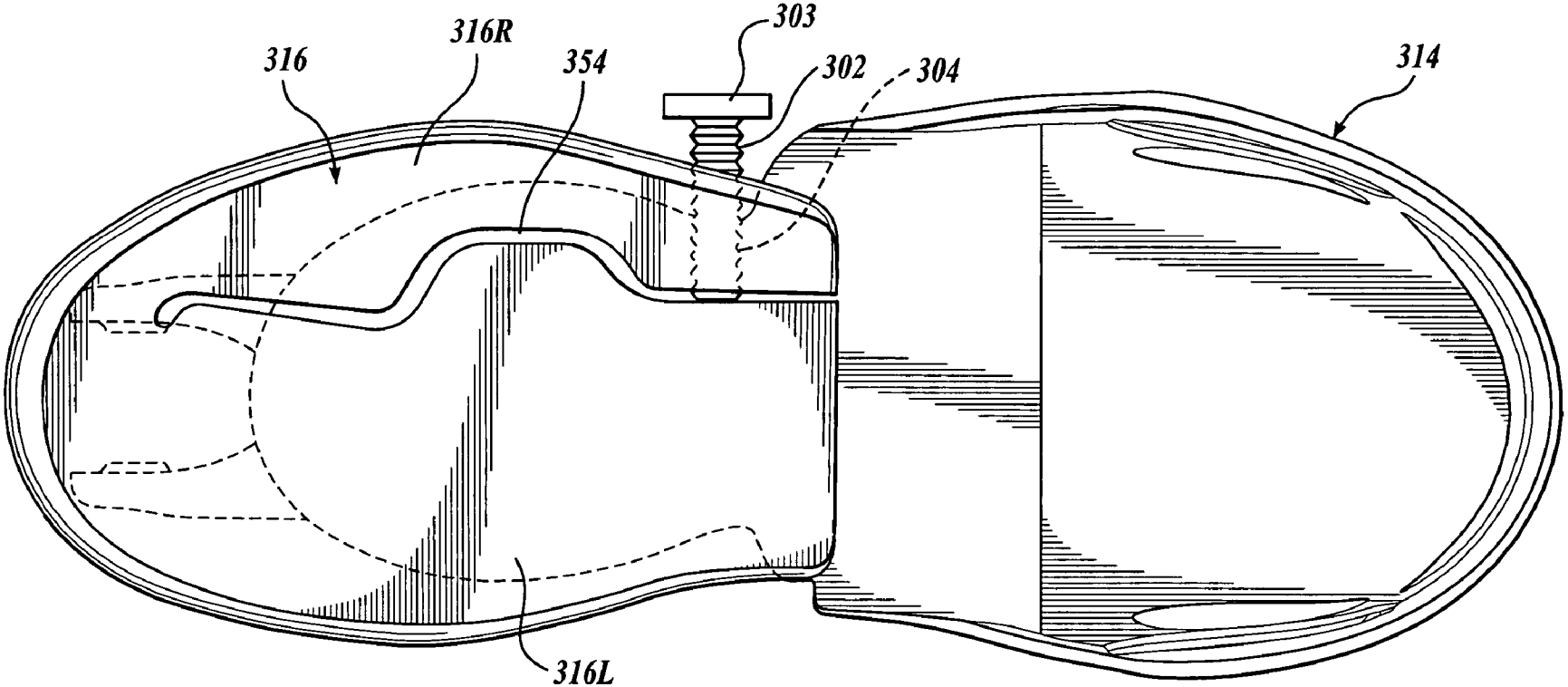
FIGS. 15A and 15B illustrate a base and toe cup for another embodiment of the present invention, wherein the width of the toe cup is adjustable independently of the length of the skate.
Figure 15B:
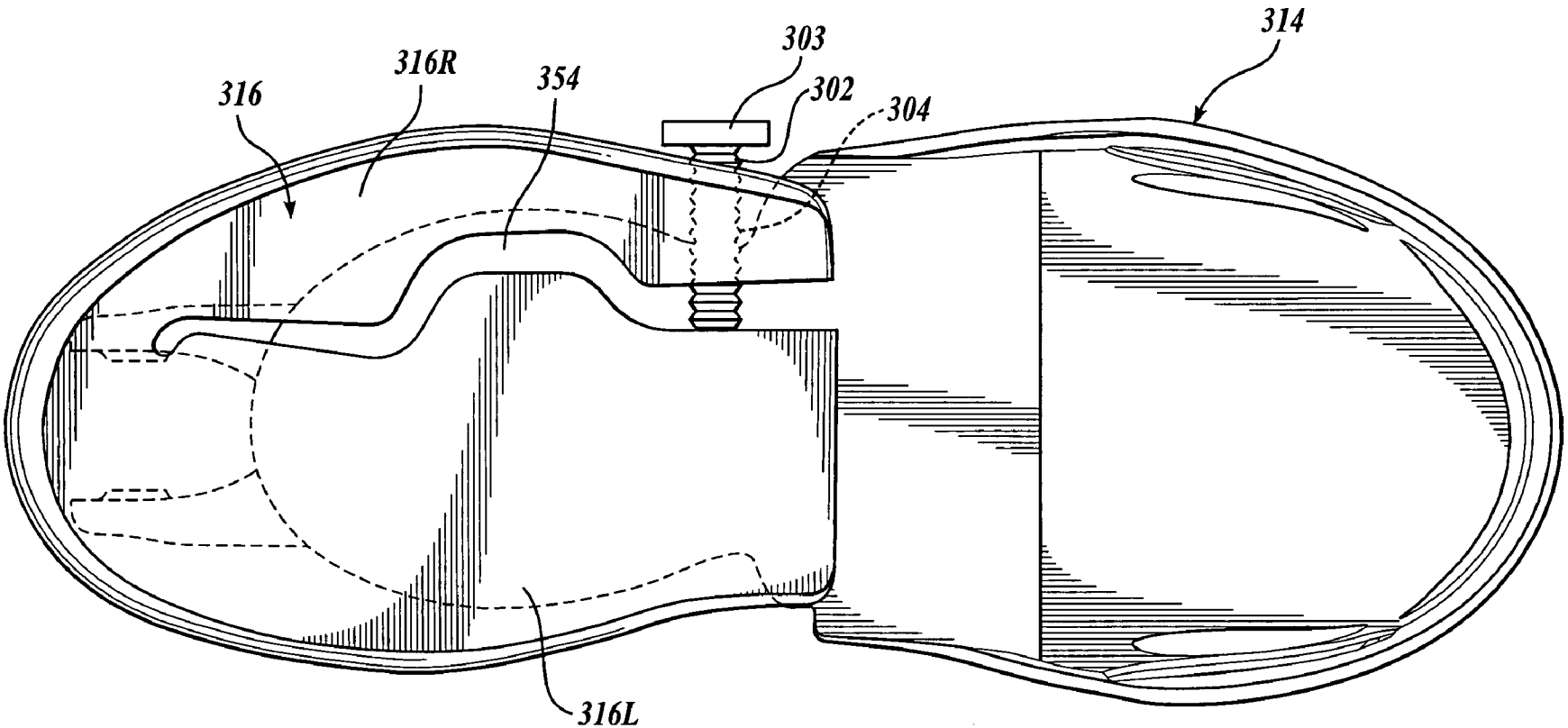

It will be apparent to persons of skill in the art that the present invention may also be practiced such that the width of the skate may be adjusted independently of the length, and/or in an embodiment wherein the skate is not length-adjustable. For example, FIGS. 15A–15B show an alternative embodiment of the present invention similar to the previously-disclosed embodiment, but wherein the base 314 includes a heel cup 320 and a toe cup 316, wherein the toe cup 316 may or may not be slidably adjustable with respect to the heel cup 320. The toe cup 316 includes an elongate slit 354 extending from the back end of the toe cup 316 through most of the length, the slit substantially bifurcating the toe cup 316 into left and right portions 316L, 316R. A threaded post 302 engages a threaded aperture 304 extending transversely through the right portion 316R, extending across the slit 354, and abutting the left portion 316L. The threaded post 302 may include a head portion 303 to facilitate adjustment of the threaded post 302, or may alternatively be an inset screw. The user can therefore adjust the width of the toe cup 316 independently of the longitudinal position of the toe cup 316, by appropriately adjusting the threaded post 302, as indicated by FIG. 15B.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A size-adjustable in-line skate comprising:

a frame that rotatably supports a plurality of wheels;

a substantially rigid base attached to the frame, the base defining a platform and a heel cup;

a semirigid toe cup that is attachable to the base, the toe cup having a floor portion having a length and a width, wherein the floor portion is adjacent to the base platform when the toe cup is attached to the base, a sidewall extending upwardly from at least a portion of the floor portion, and a slit extending along a length of the floor portion, the slit having a transverse dimension characterizing the width of the slit;

wherein the width of the toe cup may be adjusted by elastically deforming the toe cup such that the transverse dimension of the slit changes; and an upper that is adapted to cover the foot of a user, the upper being fixedly attached to the base and to the toe cup.

2. The in-line skate of claim 1, wherein the upper comprises a rearward portion that is attached to the base and a forward portion that is attached to the toe cup, and further wherein the toe cup slidably engages the floor portion of the base such that the length of the skate is adjustable.

3. The in-line skate of claim 2, wherein the width of the toe cup is determined by the adjustable length of the skate.

4. The in-line skate of claim 2, wherein the base further comprises an upwardly extending tab member and the toe cup further comprises an angled slot that is adapted to slidably receive the tab member, such that slidably adjusting the toe cup relative to the base will cause the transverse dimension of the slit in the toe cup to change.

5. The in-line skate of claim 4, wherein the tab member is T-shaped in cross section, and the angled slot is T-shaped in cross section such that the angled slot slidably captures the tab member.

6. The in-line skate of claim 4, wherein the base includes an upwardly extending longitudinal rail having a T-shaped cross section, the rail having a plurality of indents along at least one side, and further wherein the toe cup includes a T-shaped slot that slidably engages the rail, the toe cup further comprising a transverse engagement member that selectively engages at least one of the plurality of indents along the rail to lock the toe cup longitudinally with respect to the base.

7. The in-line skate of claim 2, wherein the skate further comprises an ankle cuff.

8. The in-line skate of claim 7, wherein the ankle cuff is pivotally attached to the heel cup.

9. The in-line skate of claim 2, wherein the floor further comprises a locking tab and the toe cup further comprises at least one rearwardly extending hook member that engages the locking tab.

10. A size-adjustable skate comprising:

a frame that rotatably support a plurality of wheels, the frame including a substantially horizontal platform and a heel cup;

a semirigid toe cup that is attachable to the platform, the toe cup having a floor, a sidewall extending upwardly from the floor, and a slit extending from a back edge of the floor along most of the length of the floor, the slit having an adjustable width;

wherein the width of the toe cup may be adjusted by elastically deforming the toe cup such that the width of the slit changes; and an upper that is adapted to cover the foot of a user, the upper being fixedly attached to the base and to the toe cup.

11. The skate of claim 10, wherein the upper comprises a rearward portion that is attached to the heel cup and a separable forward portion that is attached to the toe cup, and further wherein the toe cup slidably engages the floor such that the length of the skate is adjustable.

12. The skate of claim 11, wherein the width of the slit is determined by the adjustable length of the skate.

13. The skate of claim 11, wherein the platform further comprises an upwardly extending tab member and the toe cup further comprises an angled slot that is adapted to slidably engage the tab member, such that slidably adjusting the toe cup relative to the platform will cause the transverse dimension of the slit in the toe cup to change.

14. The skate of claim 13, wherein the tab member is T-shaped in cross section and the angled slot is T-shaped in cross section, such that the angled slot slidably captures the tab member.

15. The skate of claim 13, wherein the platform includes an upwardly extending longitudinal rail having a T-shaped cross section, the rail having a plurality of indents along at least one side, and further wherein the toe cup includes a T-shaped slot that slidably engages the rail, the toe cup further comprising a transverse engagement member that selectively engages at least one of the plurality of indents along the rail to lock the toe cup longitudinally with respect to the platform.

16. The skate of claim 11, wherein the skate further comprises an ankle cuff.

17. The skate of claim 16, wherein the ankle cuff is pivotally attached to the heel cup.

18. The skate of claim 11, wherein the platform further comprises a locking tab and the toe cup further comprises at least one rearwardly extending hook member that engages the locking tab.

19. A size-adjustable skate comprising:

a frame;

a plurality of wheels rotatably journaled in the frame;

a substantially rigid base integrally formed with the frame, the base defining a forward platform and a rearward heel cup;

a semirigid toe cup that is removably attachable to the base, the toe cup having a floor, wherein the floor is adjacent to the forward platform when the toe cup is attached to the base, and a slit extending along most of the length of the floor, the slit having an adjustable width;

wherein the width of the toe cup may be adjusted by elastically deforming the toe cup such that the transverse dimension of the slit changes; and a two-piece upper that is adapted to cover the foot of a user, the upper having a toe portion that is fixedly attached to the toe cup and a rearward portion that is fixedly attached to the heel cup.

20. An in-line skate having a longitudinal direction, the skate comprising:

a frame adapted to rotatably support a plurality of wheels;

a lateral base attached to the frame, the base defining a platform and a heel cup;

a toe cup having a floor portion with slit extending therealong in a generally longitudinal direction, the slit having a transverse width dimension; the toe cup being longitudinally slidingly engaged with the base;

a mating slot and pin, the slot being located on one of the toe cup and the base, the slot being located on the other of the toe cup and the base; the slot being oriented such that as the toe cup is slid away from the heel cup, the width of the slit increases thereby enlarging the overall width of the toe cup; and an upper adapted to support a foot and connected to the base and the toe cup.

21. The skate according to claim 20, wherein the pin is located on an upper surface of the platform and the slot is located on the lower surface of the toe cup.

* * * * *